US006232948B1

(12) United States Patent
Tsuchi

(10) Patent No.: US 6,232,948 B1
(45) Date of Patent: May 15, 2001

(54) LIQUID CRYSTAL DISPLAY DRIVING CIRCUIT WITH LOW POWER CONSUMPTION AND PRECISE VOLTAGE OUTPUT

(75) Inventor: Hiroshi Tsuchi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/066,550

(22) Filed: Apr. 27, 1998

(30) Foreign Application Priority Data

Apr. 28, 1997 (JP) ..... 9-111183

(51) Int. Cl.[7] ..... G09G 3/36
(52) U.S. Cl. ..... 345/99; 345/89; 345/98
(58) Field of Search ..... 345/87, 89, 94, 345/95, 98, 99, 204, 211

(56) References Cited

U.S. PATENT DOCUMENTS

| | | | | |
|---|---|---|---|---|
| 5,926,160 | * | 7/1999 | Furuya | 345/98 |
| 5,963,188 | * | 10/1999 | Kim | 345/98 |
| 6,008,438 | * | 9/2000 | Ho | 345/98 |
| 6,014,122 | * | 1/2000 | Hashimoto | 345/98 |
| 6,049,321 | * | 4/2000 | Sasaki | 345/98 |
| 6,124,840 | * | 9/2000 | Kwon | 345/100 |

FOREIGN PATENT DOCUMENTS

| | | |
|---|---|---|
| 57-120991 | 7/1982 | (JP) . |
| 2-8813 | 1/1990 | (JP) . |
| 5-119732 | 5/1993 | (JP) . |
| 5-134628 | 5/1993 | (JP) . |
| 6-186934 | 7/1994 | (JP) . |
| 7-236844 | 9/1995 | (JP) . |
| 9-222930 | 8/1997 | (JP) . |
| 8-201765 | 8/1996 | (KR) . |
| 8-254684 | 10/1996 | (KR) . |

* cited by examiner

*Primary Examiner*—Kent Chang
(74) *Attorney, Agent, or Firm*—Sughrue, Mion, Zinn, Macpeak & Seas, PLLC

(57) ABSTRACT

A driving circuit for a liquid crystal display in an active matrix scheme is provided. The driving circuit comprises a multi-value voltage generating circuit, a selection circuit and an output circuit. The output circuit includes an output circuit input terminal for inputting a voltage selected by the selection circuit, a first switch connected between the output circuit input terminal and the driving circuit output terminal, a transistor having a drain connected to the first voltage source, a gate connected to the output circuit input terminal and a source connected to the driving circuit output terminal, and a second switch connected between the driving circuit output terminal and the second voltage source. During a first driving period, the driving circuit output terminal is pre-charged to a predetermined voltage by controlling the first switch and the second switch. During a second driving period, the transistor is operated as a source follower to output a voltage to the driving circuit output terminal. During a third driving period, the voltage of the output circuit input terminal is directly outputted to the driving circuit output terminal through the first switch.

8 Claims, 16 Drawing Sheets

LIQUID CRYSTAL DISPLAY DRIVING CIRCUIT WITH LOW POWER CONSUMPTION AND PRECISE VOLTAGE OUTPUT

BACKGROUND OF THE INVENTION

1. Field of the Invention

The present invention relates to a driving circuit for a liquid crystal display in an active matrix driving scheme.

2. Description of the Related Art

Liquid crystal displays are used in various devices, for example portable devices and portable terminals such as notebook computers due to the characteristics of the thin shape, light weight and low power. Among them, liquid crystal displays using an active matrix driving scheme are increasingly in demand due to the characteristics of fast response, very fine display and display in multiple levels of gradation. A display unit of the liquid crystal display using an active matrix driving scheme generally comprises a semiconductor substrate having transparent pixel electrodes and thin film transistors (TFT) arranged thereon, an opposite substrate having a transparent electrode (common electrode) formed over its surface and a structure having the two substrates opposing each other to encapsulate the liquid crystal therebetween. A graduation voltage is applied to each pixel electrode by controlling the TFT with a switching function and transmittance of the liquid crystal is changed by voltage differences between each pixel electrode and the electrode on the opposing substrate to provide display on the screen. Data lines for sending a gradation voltage (data signal) to be written to each pixel electrode and scanning lines for sending a switching control signal (scanning signal) for the TFT are wired on the semiconductor substrate. A pulse-shape scanning signal is sent to each scanning line from a gate driver. When the scanning signal of the scanning line is at a high level, all the TFTs connecting the scanning line are turned on, and the gradation voltages (data signals) sent to the data line are written to the pixel electrodes through the TFTs. When the scanning signal becomes of low level to change the TFT to the off state, the difference between the gradation voltage written to the pixel electrode and the voltage at the common electrode is maintained until the graduation voltage is rewritten to the pixel electrode. All the pixel electrodes are written with predetermined voltages by sequentially sending the scanning signal to each scanning line, and display on the screen can be achieved by rewriting in a frame period.

In this way, the liquid crystal is driven by writing the gradation voltage to the pixel electrode through the data line in the liquid crystal display. A data driver for driving the data line must drive not only a liquid crystal capacitance for one pixel but also a large capacitive load including wiring resistance and wiring capacitance. As a large capacitance data line load needs to be fast driven at a high voltage precision in order to achieve a very fine display and display in multiple levels of gradation, a high performance data driver is required, so that various data drivers have been developed. Among them, a first prior art shown in FIG. 1 is one which enables a highly precise voltage output. In the prior art, a gradation voltage generated by a resistance string 1A is selected by a selection circuit 3 to be outputted directly to a data line load 5, so that the voltage precision depends on the resistance ratio of resistance elements comprising the resistance string 1, and a highly precise voltage output can be provided. Although FIG. 1 shows a driving circuit for one data line, even with a plurality of data lines, variations in the output voltage for each data line hardly occurs by sharing a resistance string.

In addition, as the number of scanning lines and the number of data lines are increased due to a finer panel, an output period for one data is shortened and a high current supply capability is required for the data driver in order to fast drive the data line load. A second prior art shown in FIG. 3 and a third prior art shown in FIG. 4 (Japanese Patent Application No. 27623/96) are ones which meet such requirements. The second prior art (FIG. 3) is a driving circuit in which a gradation voltage generated by a resistance string 1A is selected by a selection circuit 3 to be amplified by an operational amplifier 7 and outputted to a one data line load 5. This driving circuit has a high current supply capability as an impedance conversion is performed by the operational amplifier 7, so that the data line load can be fast driven. The third prior art (FIG. 4) is a multi-value voltage source circuit in which a voltage generated by a resistance element group 31 is selected by a semiconductor switch group $SW_1, SW_2, \ldots, SW_{n+1}$ to be biased to a gate of a MOS transistor Tr, and the voltage which is decreased from the gate bias voltage by a threshold voltage is taken from a source to be outputted. In this circuit, the MOS transistor Tr is operated as a source follower, so that the multi-value voltage can be outputted at a low impedance, and the data line load can be fast driven when this circuit is used as a driving circuit for a data driver. Also, a highly precise voltage can be produced by connecting voltage control circuits 32 and current control circuits 33 at both ends of the resistance element group 31 to correct variations in the threshold voltage of the MOS transistor Tr.

In order to utilize the liquid crystal display for portable devices and portable terminals, not only a highly precise voltage output and a fast driving capability but also a smaller power consumption is required.

For the first prior art (FIG. 1), however, the gradation voltage is outputted from each connecting terminal within the resistance string 1A, so that the output impedance varies depending on the gradation voltage. In this case, as the driving speed depends on a time constance of the delay through the impedance of the data line load and the output impedance of the resistance string 1A, the time constant of the delay needs to be decreased by reducing the resistance value of the resistance string 1A generating the gradation voltage to fast drive the data line for an arbitrary gradation. However, there is a problem that when the resistance value of the resistance string 1A is decreased, a current across the resistance string 1A is increased in the case of a constant supply voltage, and the consumption power at the driving circuit is increased.

On the other hand, for the second prior art (FIG. 3), the power consumption through an internal current in the operational amplifier occurs in addition to the consumption power through a current across the resistance string 1A and a charge and discharge of the data line, so that the consumption power is considerable for a very fine panel with a number of data lines. Also, the operational amplifier has an offset resulting from variations in the characteristics of the transistor, so that variations in the output voltage precision can occur.

For the third prior art (FIG. 4), although the power consumption exists through a current across the resistance element group and a charge and discharge of the data line load, the current across the resistance element group can be suppressed as an impedance conversion is performed by the MOS transistor, so that the consumption power is relatively small. However, there is a problem that the structure of the driving circuit is complicated as the voltage control circuits and the current control circuits are connected at both ends of the resistance element group to prevent the output voltage from varying due to variations in the threshold voltage of the MOS transistor.

In this way, it is difficult to simultaneously realize a highly precise voltage output, fast driving and low power consumption using a simple circuit structure for a greatly fine panel with a number of data lines in a driving circuit of the prior art liquid crystal display.

SUMMARY OF THE INVENTION

It is an object of the present invention to provide a driving circuit for a liquid crystal display which simultaneously realizes a highly precise voltage output, fast driving and low power consumption using a simple circuit structure.

In a driving circuit of a first liquid crystal display in accordance with the present invention, an output circuit includes an output circuit input terminal for inputting an voltage selected by a selection circuit, a driving circuit output terminal, a first voltage source, a second voltage source, a first switch connected between the output circuit input terminal and the driving circuit output terminal, a transistor having a drain connected to the first voltage source, a gate connected to the output circuit input terminal and a source connected to the driving circuit output terminal, and a second switch connected between the driving circuit output terminal and the second voltage source.

In a driving circuit of a second liquid crystal display in accordance with the present invention, an output circuit includes an output circuit input terminal for inputting a voltage selected by a selection circuit, a driving circuit output terminal, a first voltage source, a second voltage source, a switch connected between the output circuit input terminal and the driving circuit output terminal, an n channel type transistor having a drain connected to the first voltage source, a gate connected to the output circuit input terminal and a source connected to the driving circuit output terminal, and a p channel type transistor having a drain connected to the second voltage source, a gate connected to the output circuit input terminal and a source connected to the driving circuit output terminal.

The operation of the present invention will be described. It should be noted that description will be made in the case of a simple structure in which multi-value voltage generating means comprises a resistance string having resistance elements connected in series and a voltage is generated from each connecting terminal within the resistance string for a simple description. In addition, assuming that an arbitrary gradation voltage selected by the selection circuit and inputted to the output circuit is $V_k$, a threshold voltage of the n channel type transistor in the output circuit is $V_t$, and a threshold voltage of the p channel type transistor is Vt. A description will be made when a data line load is connected to the driving circuit output terminal and this data line load is driven.

First, the driving circuit of the first liquid crystal display will be described.

The output circuit has three stages of driving periods, that is, a first driving period in which the driving circuit output terminal is precharged to a predetermined voltage with the second voltage source by controlling the first switch and the second switch, a second driving period in which the transistor is operated as a source follower to output a voltage to the driving circuit output terminal and a third driving period in which the voltage of the output circuit input terminal is directly outputted to the driving circuit output terminal through the first switch.

In the first driving period, when the first switch and the second switch in the output circuit are turned on, the gate and source of the first transistor become the same potential, so that the first transistor becomes the off state and the data line load is precharged at a predetermined voltage with the second voltage source. When the first switch and the second switch are turned off in the second driving period, the gradation voltage $V_k$ selected by the selection circuit is biased to the gate of the first transistor, and the voltage ($V_k$–Vt) is outputted to the data line load from the source through the driving circuit output terminal. At this point, the first transistor is operated as a source follower, electric charges are provided from the first voltage source through the impedance conversion, and the data line load can be fast driven up to near the voltage ($V_k$–Vt). In the third driving period, when the first switch is turned on and the second switch is turned off, then the first transistor is turned off and the gradation voltage $V_k$ is directly outputted to the data line through the first switch. At this point, the voltage generated by the resistance string is directly outputted to the data line load, so that the driving speed in the third driving period depends on the output impedance of the resistance string. For the resistance string, the output impedance varies depending on the gradation voltage, the driving speed in the third driving period depends on a time constant of the delay through the impedance of the data line load and the output impedance of the resistance string. However, in the third driving period, only the voltage difference approximately the threshold voltage VT is driven, and a required output voltage precision is reached in a short time even with a relatively large time constant of the delay. Thus, a current across the resistance string can be suppressed with a relatively large resistance value of the resistance string, making it possible to decrease the consumption power in the driving circuit. In this way, by providing the three stages of driving periods to achieve driving for one output period, a fast driving can be accomplished for the entire one output period, and a highly precise gradation voltage can be outputted to the data line load by directly outputting the voltage outputted from the multi-value voltage generating means. Also, the driving circuit can be realized with a simple structure and can be driven with a low consumption power.

Next, the driving circuit of the second liquid crystal display will be described.

The output circuit has two stages of the driving periods, that is, a first driving period in which the n channel type transistor or the p channel type transistor is operated as a source follower to output a voltage to the driving circuit output terminal by controlling the switch, and a second driving period in which a voltage at the output circuit input terminal is directly outputted to the driving circuit output terminal through the switch.

For the driving circuit of the second liquid crystal display, the operations of the first driving period and the second driving period are similar to those of the second driving period and the third driving period in the driving circuit of the first liquid crystal display. It should be noted that precharge is not required for the driving circuit of the second liquid crystal display. The reason is that the n channel type transistor is operated in the first driving period when an output voltage is higher than the output voltage in the previous output period, and the p channel type transistor is operated when an output voltage is lower than the output voltage in the previous output period. Thus, by providing the two stages of driving periods to achieve driving for one output period, a fast driving can be accomplished for the entire one output period, and a highly precise gradation voltage can be outputted to the data line load by directly outputting the voltage generated by the resistance string in the driving period. Also, the driving circuit can be realized with a simple structure and can be driven with a low consumption power.

As compared with the first prior art, the present invention can realize a fast driving even with a suppressed current across the resistance string, so that a consumption power can be decreased over the first prior art. As compared with the second prior art, the present invention also can realize a lower consumption power over the second prior art as no power loss exists such as the inner current of the operational amplifier. Also, in the present invention, the output voltage of the multi-value voltage output means is directly outputted to the data line load and the variations in the output voltage due to an offset of the operational amplifier does not exist as seen in the second prior art, so that a highly precise voltage can be outputted to the data line load. As compared with the third prior art, the present invention eliminates a correction circuit for correcting variations in the threshold voltage of the transistor, making the circuit structure simple and the design easy.

The above and other objects, features and advantages of the present invention will become apparent from the following description with reference to the accompanying drawings which illustrate examples of the present invention.

DESCRIPTION OF PREFERRED EMBODIMENTS

Figure 5:
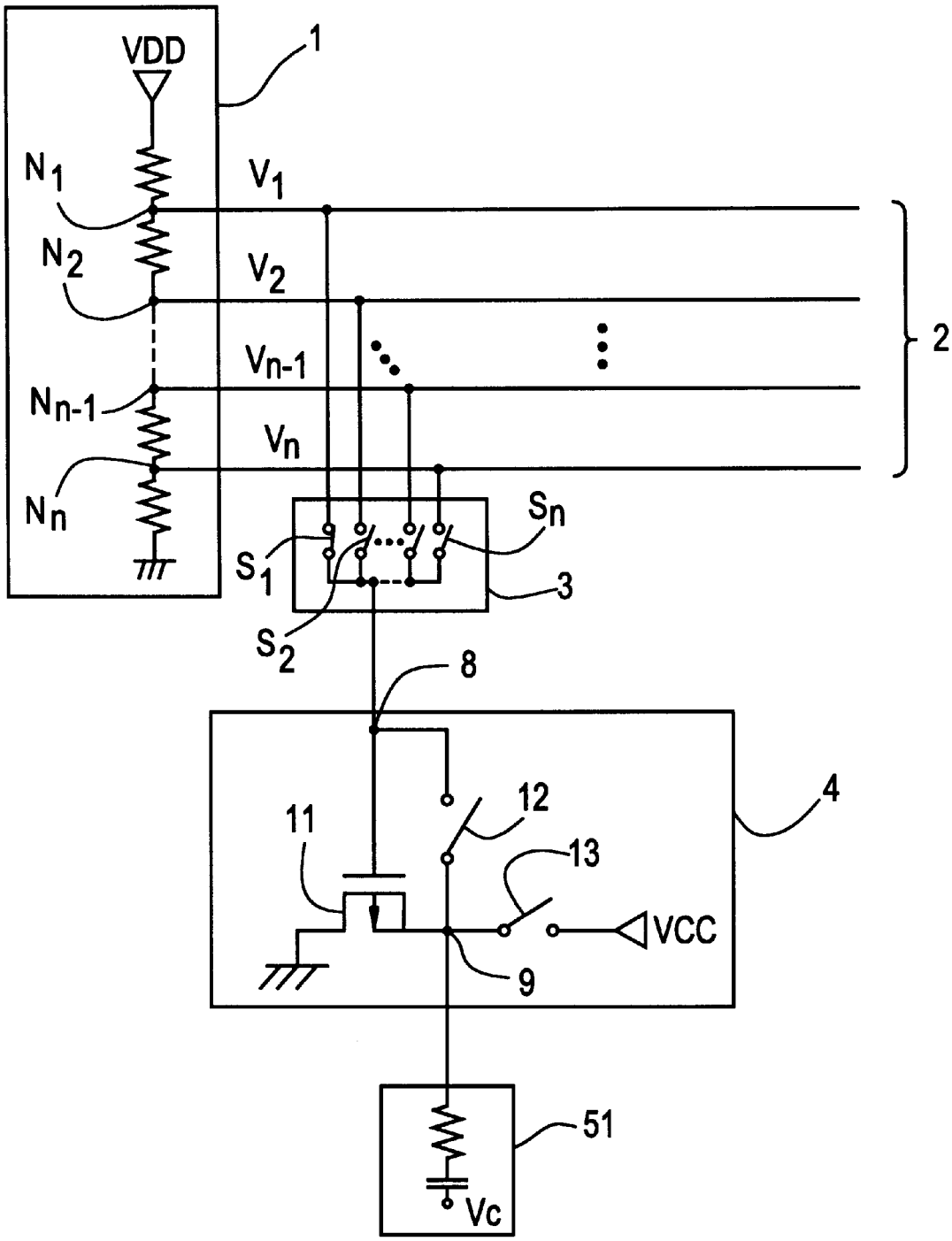
FIG. 5 is a circuit diagram of a driving circuit for a liquid crystal display of a first embodiment in accordance with the present invention.

Referring to FIG. 5, a driving circuit for a liquid crystal display of a first embodiment in accordance with the present invention comprises a multi-value voltage generating circuit 1 for outputting a plurality of voltages $V_1, V_2, \ldots, V_n$, a selection circuit 3 for selecting a voltage required for driving from the voltages $V_1$ to $V_n$ generated by the multi-value voltage generating circuit 1 and an output circuit 4 for inputting the voltage selected by the selection circuit 3 to output a desired voltage to a one data line load 5 through a driving circuit output terminal 9.

The multi-value voltage generating circuit 1 consists of a resistance string having resistance elements connected in series, and a gradation voltage is outputted from each connecting terminal $N_1, N_2, \ldots, N_n$ within the resistance string to a gradation voltage line group 2 which is common to a plurality of outputs of a data driver. An arbitrary gradation is selected at the selection circuit 3 and the gradation voltage is outputted from the output circuit 4 to the one data line load 5 and the voltage is maintained for a certain period. It should be noted that FIG. 5 shows only the component of the selection circuit 3 and the output circuit 4 required for driving one data line. When multiple data lines are outputted with the voltage, the selection circuit 3 and the output circuit 4 are provided for each data line. The output circuit 4 comprises an output circuit input terminal 8, a driving circuit output terminal 9, a p channel type MOS transistor (hereinafter referred to as a PMOS transistor) 11, a switch 12 and a switch 13. The PMOS transistor 11 has a drain grunded, a gate connected to the output circuit input terminal 8 and a source connected to the driving circuit output terminal 9. The switch 12 is connected between the output circuit input terminal 8 and the driving circuit output terminal 9 and the switch 13 is connected between the driving circuit output terminal 9 and a voltage source VCC.

Figure 6:
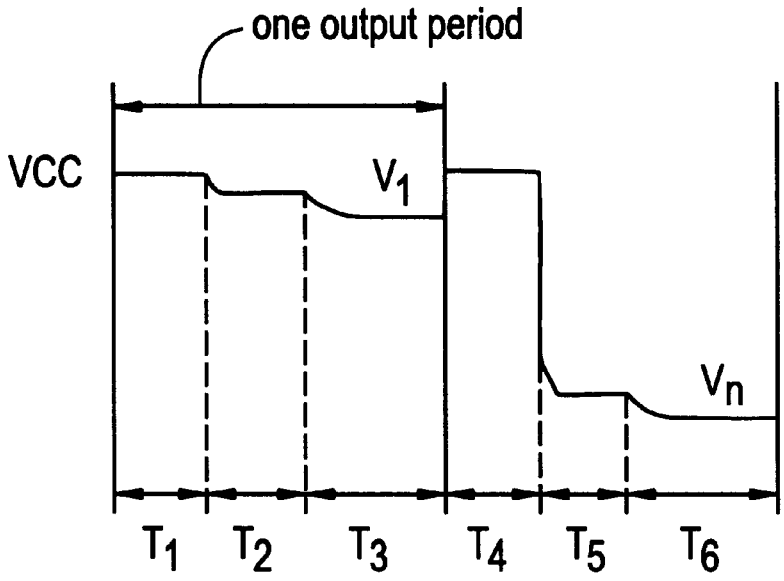
FIG. 6 is an output waveform diagram of a first driving example in the driving circuit shown in FIG. 5.

FIG. 6 is an output waveform diagram for two output periods showing a first driving example in the circuit configuration shown in FIG. 5. Table 1 shows the state of each switch in such a case.

TABLE 1

| | $T_1$ | $T_2$ | $T_3$ | $T_4$ | $T_5$ | $T_6$ |
|---|---|---|---|---|---|---|
| selection circuit 3 | all off | only $S_1$ on | | all off | only $S_n$ on | |
| switch 12 | on | off | on | | off | on |
| switch 13 | on | off | | on | off | |

The driving method will be briefly explained based on the table. In the following description, a threshold voltage of the PMOS transistor 11 is denoted by VT and the voltage VCC of the voltage source VCC is assumed to be greater $V_1$. In the period $T_1$, the switch 13 is turned on and the one data line load 5 is first precharged at the voltage VCC. At this point, the switch 12 is turned on and the PMOS transistor 11 is turned off. Also, the switches $S_1$ to $S_n$ of the selection circuit 3 are all turned off to prevent a current from flowing reversely from the voltage VCC to the gradation voltage line group 2. This period will be hereinafter referred to as a precharge period. Next, in the period $T_2$, only the switch $S_1$ is turned on in the selection circuit 3 to select the gradation voltage V1. While the gate of the PMOS transistor 11 is biased to the voltage V1, when both the switch 12 and the switch 13 are turned off, then PMOS transistor 11 is turned on, and charges accumulated in the one data line load 5 is discharged to the ground surface of the drain of the transistor 11, and the voltage of the one data line load 5 is rapidly decreased from the VCC to approach the voltage (V1−VT). The period in which the MOS transistor 11 is operated as a source follower to drive the one data line load 5 will be hereinafter referred to as a transistor driving period. Next, in the period $T_3$, when the switch 12 is turned on, then the PMOS transistor 11 is turned off and the gradation voltage V1 is directly outputted to the one data line load 5 through the switch 12, and one output period is terminated. This period in which an output of the selection circuit 3 is directly outputted to the one data line load 5 will be hereinafter referred to as a direct driving period. Similarly, for the next output periods $T_4$ to $T_6$, the one data line load 5 is precharged at the voltage VCC in the $T_4$ precharge period, a gradation voltage $V_n$ is selected to output the voltage ($V_n$−VT) to the one data line load 5 in the $T_5$ transistor driving period, and the gradation voltage $V_n$ is directly outputted to the one data line load 5 in the $T_6$ direct driving period.

With such a driving method, a fast driving can be achieved at a low impedance without depending on a gradation in the transistor driving period as the PMOS transistor 11 serves as a source follower, a highly precise voltage can be outputted by directly outputting an output of the selection circuit 3 to the one data line load 5 in the direct driving period. It should be noted that as an output impedance varies depending on a gradation voltage in the direct driving period, the driving speed depends on a time constant of the delay through the impedance of the data line load and the output impedance of the resistance string. However, only the voltage difference for the threshold voltage VT can be driven in the direct driving period, and a required output voltage precision is reached in a short time even with a relatively large time constant. Thus, a fast driving can be achieved for the entire one output period even with a large resistance value of the resistance string. In particular, a current across the resistance string can be suppressed and the consumption power for the entire driving circuit can be decreased in this embodiment. It should be noted that when an arbitrary gradation voltage $V_k$ satisfies the equation $(VCC-V_k)<-VT$ in the transistor driving period, the transistor 11 remains turned off, the voltage difference driven in the direct driving period is equal to or less than the threshold voltage VT, so that a fast driving can be achieved only in the direct driving period. Also, when this embodiment is used for a data driver IC with multiple outputs, an output voltage of the data line depends on a resistance ratio of the resistance elements comprising the resistance string, so that even though variations occur in the threshold voltage of the PMOS transistor between the ICs or within the IC, a highly precise voltage output can be provided without depending on the variations in the threshold voltage. In this way, this embodiment can simultaneously realize a highly precise voltage output, fast driving and low power consumption with a simple circuit structure.

Figure 7:
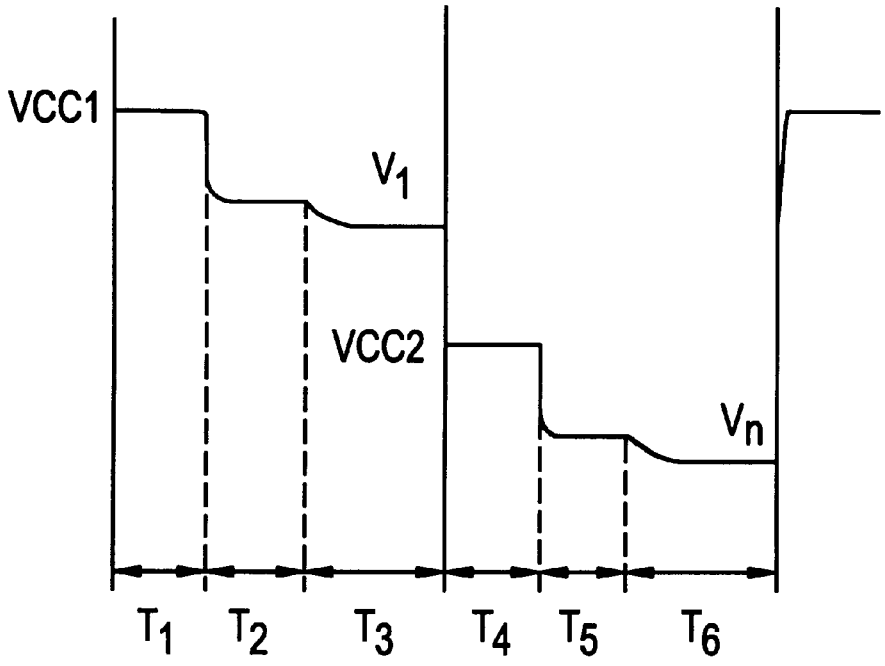
FIG. 7 is an output waveform diagram of a second driving example in the driving circuit shown in FIG. 5.

Although FIG. 6 shows a case where the voltage source VCC is at a constant voltage, the level of the voltage VCC can be changed for each output period. FIG. 7 shows a second driving example in which the voltage of the voltage source VCC is changed for each output period. FIG. 7 shows an output waveform diagram when the voltage of the voltage source VCC is changed as VCC1, VCC2, and the switching control is performed similar to that of FIG. 6. In this case, the voltages are set as $VCC1>V_1>VCC2>V_n$. In this embodiment, it is more effective as the absolute value of the threshold voltage VT of the transistor 11 is smaller. When a transistor with a small absolute value of the threshold voltage is used, the voltage difference which must be driven in the direct driving period is decreased and the driving speed is faster, so that the current across the resistance string can be suppressed to decrease the consumption power within the limit of a required driving speed.

Figure 8:
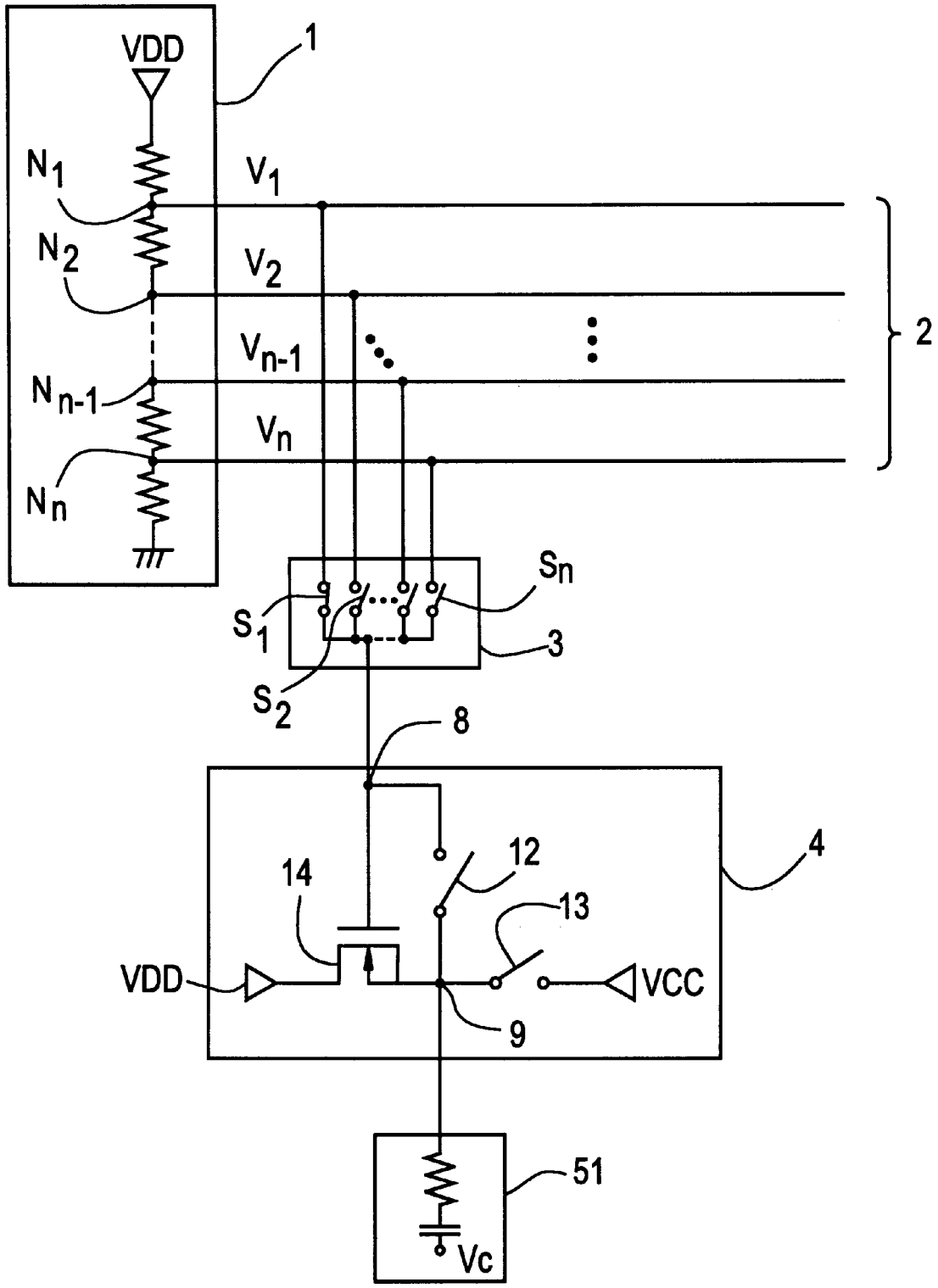
FIG. 8 is a circuit diagram of a driving circuit for a liquid crystal display of a second embodiment in accordance with the present invention.

Referring to FIG. 8, a driving circuit for a liquid crystal display of a second embodiment in accordance with the present invention has an n channel type MOS transistor (hereinafter referred to as an NMOS transistor) 14 in place of the PMOS transistor 11 of the driving circuit shown in FIG. 5, with its drain connected a voltage source VDD.

Figure 9:
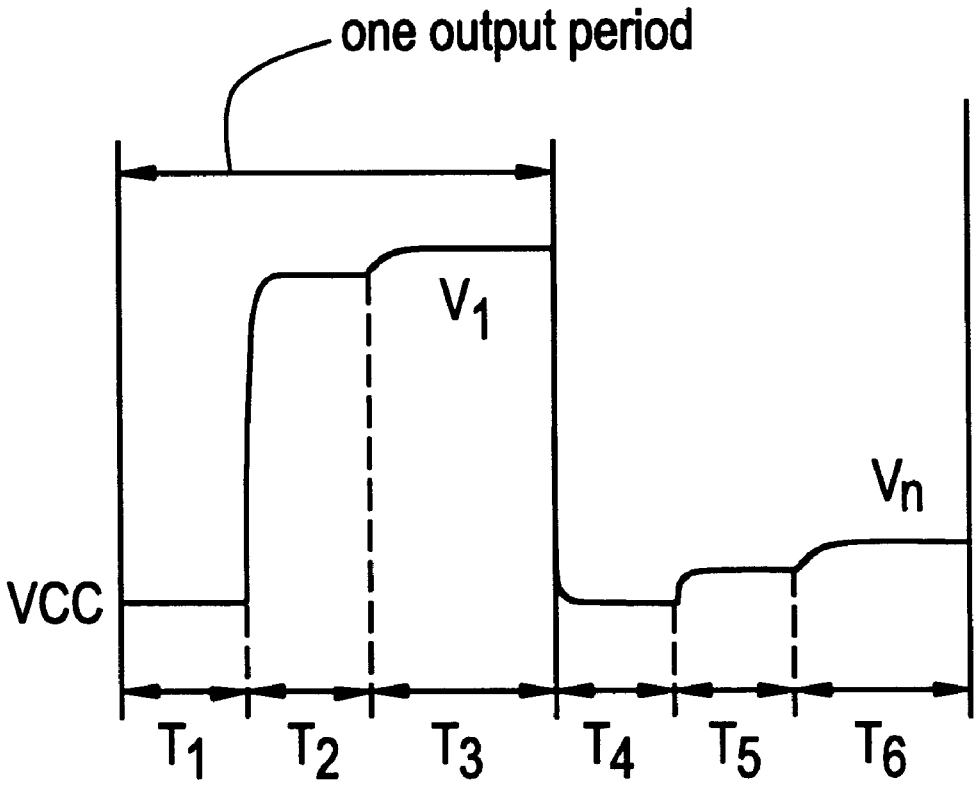
FIG. 9 is an output waveform diagram of a driving example in the driving circuit shown in FIG. 8.

FIG. 9 is an output waveform diagram for two output periods to a data line load 5 showing a first driving example in the circuit structure shown in FIG. 8. Table 2 shows the state of each switch in such a case.

TABLE 2

| | $T_1$ | $T_2$ | $T_3$ | $T_4$ | $T_5$ | $T_6$ |
|---|---|---|---|---|---|---|
| selection circuit 3 | all off | only $S_1$ on | | all off | only $S_1$ on | |
| switch 12 | on | off | on | | off | on |
| switch 13 | on | off | | on | off | |

The driving method of the present embodiment is similar to that of FIG. 6. $T_1$ and $T_4$ are precharge periods, $T_2$ and $T_5$ are transistor driving periods, and $T_3$ and $T_6$ are direct driving periods in which an output of the selection circuit 3 is directly outputted to the data line load 5. With the driving in this way, a highly precise voltage output, fast driving and low consumption power can be simultaneously realized with a simple circuit structure similar to the first embodiment.

Figure 10:
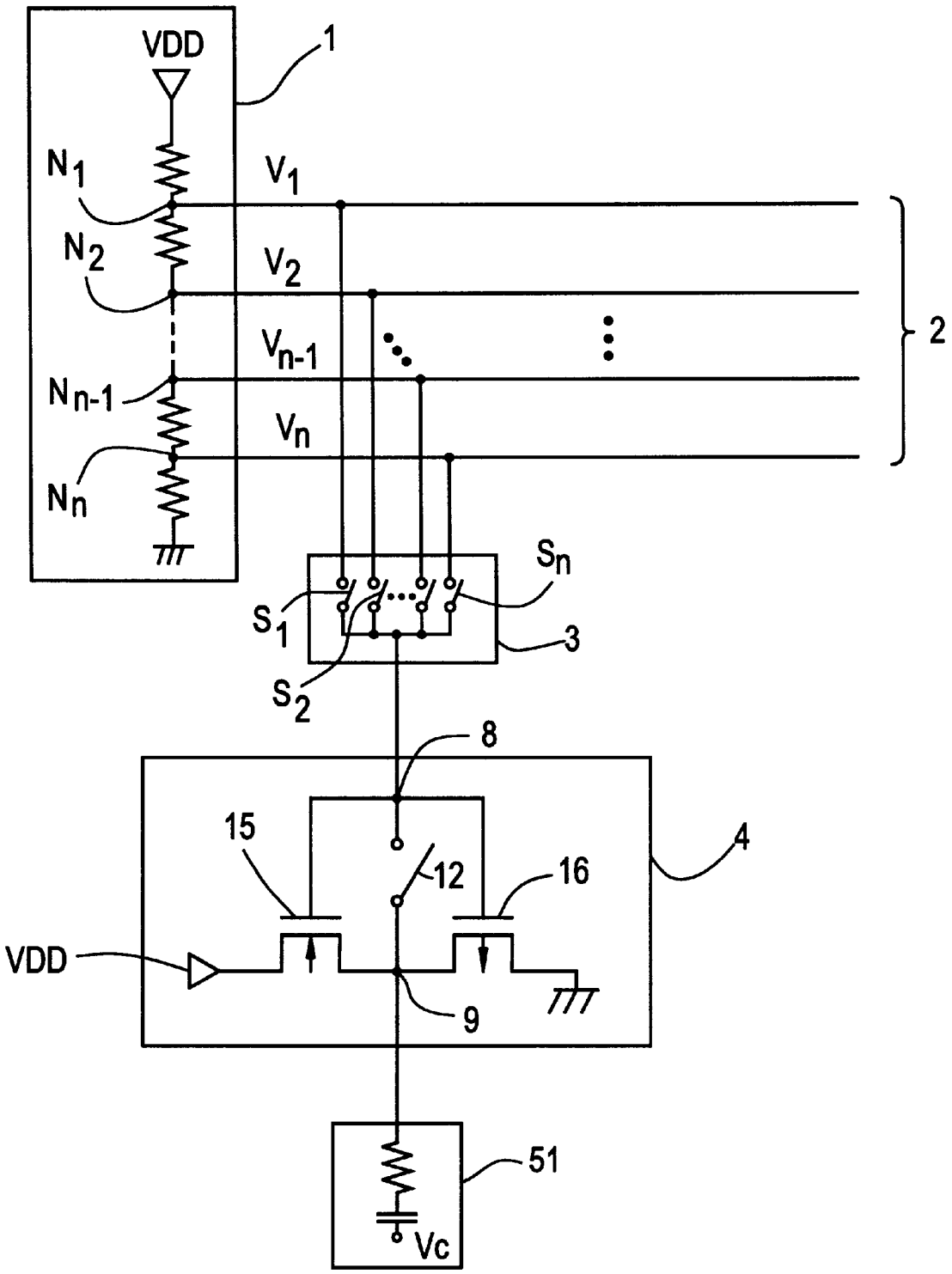
FIG. 10 is a circuit diagram of a driving circuit for a liquid crystal display of a third embodiment in accordance with the present invention.

Referring to FIG. 10, a driving circuit for a liquid crystal display of a third embodiment in accordance with present invention differs from the first and second embodiments only in an output circuit 4. The output circuit 4 consists of an output circuit input terminal 8, a driving circuit output terminal 9, a switch 12, an NMOS transistor 15 and a PMOS transistor 16. The switch 12 is connected between the output circuit input terminal 8 and the driving circuit output terminal 9 similar to the first and second embodiments, the NMOS transistor 15 has a drain connected to a voltage source VDD, a gate connected to the output circuit input terminal 8 and a source connected to the driving circuit output terminal 9, and the PMOS transistor 16 has a drain connected to ground, a gate connected to the output circuit input terminal 8 and a source connected to the driving circuit output terminal 9.

Figure 11:
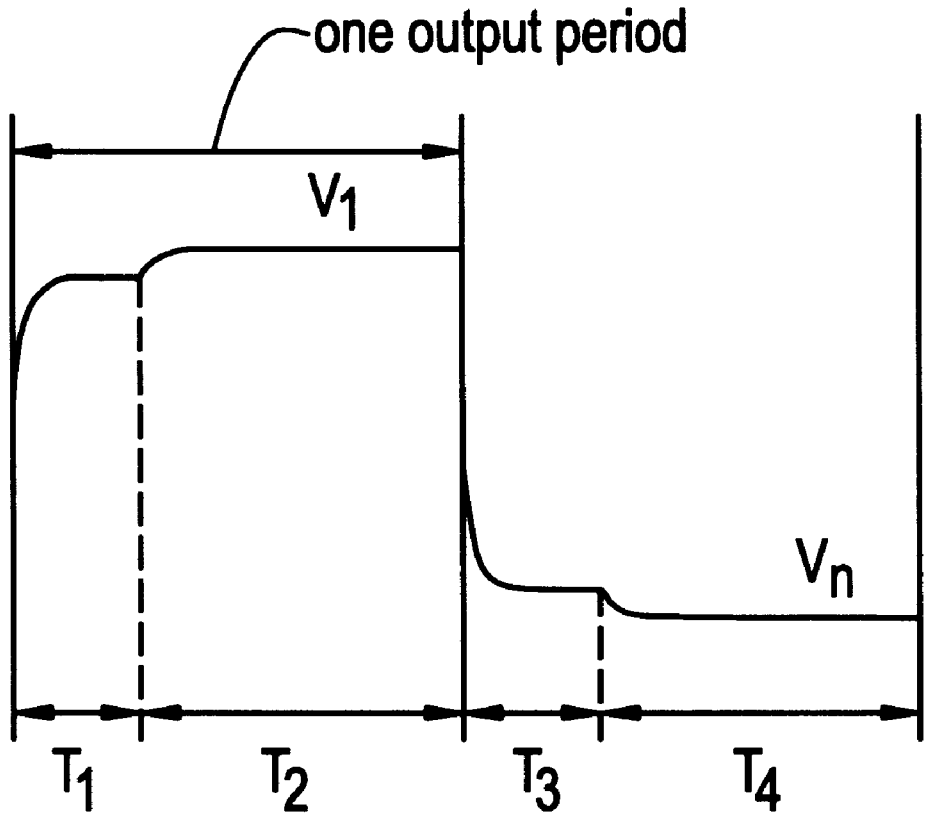
FIG. 11 is an output waveform diagram of a driving example in the driving circuit shown in FIG. 10.

FIG. 11 is an output waveform for two output periods showing a driving example in the circuit structure shown in FIG. 10. Table 3 shows the state of each switch in such a case.

TABLE 3

| | $T_1$ | $T_2$ | $T_3$ | $T_4$ |
|---|---|---|---|---|
| selection circuit 3 | only $S_1$ on | | only $S_n$ on | |
| switch 12 | off | on | off | on |

The driving method will be briefly described based on the table. The threshold voltages of the NMOS transistor 15 and the PMOS transistor 16 are denoted by $V_t$ and VT, respectively. $T_1$ is a transistor driving period in which the switch 12 is turned off, only the switch $S_1$ is turned on in the selection circuit 3 to select a gradation voltage V1, and the gates of the NMOS transistor 15 and the PMOS transistor 16 are biased to the voltage V1. At this point, when the voltage maintained in the one data line load 5 in the previous output period is sufficiently lower than the V1, the NMOS transistor 15 is turned on and the PMOS transistor 16 is turned off. Then, the voltage at the one data line load 5 is rapidly increased to approach the voltage ($V1-V_t$). $T_2$ is a direct driving period in which, when the switch 12 is turned on, the NMOS transistor 15 and the PMOS transistor 16 are turned off and the gradation voltage V1 is directly outputted to the one data line load 5, and one output period is terminated. In the next output period, when a gradation voltage $V_n$ is selected by the selection circuit 3, the NMOS transistor 15 is turned off and the PMOS transistor 16 goes on in $T_3$ transistor driving period. The voltage at the one data line load 5 is rapidly decreased to approach the voltage ($V_n-VT$). Then, then the switch 12 is turned on in $T_4$ direct driving period, the NMOS transistor 15 and the PMOD transistor 16 are turned off and the gradation voltage $V_n$ is directly outputted to the one data line load 5.

With the driving method in this way, a fast driving can be achieved at a low impedance without depending on a gradation as the transistor serves as a source follower in the transistor driving period, and a highly precise voltage can be outputted by directly outputting an output of the selection circuit 3 to the one data line load 5 in the direct driving period. It should be noted that although when the potential difference between the voltage to be outputted and the voltage maintained in the previous output period is lower than the absolute value of the threshold voltage of the NMOS transistor 15 or the PMOS transistor 16, both the NMOS transistor 15 and the PMOS transistor 16 may be turned off in the $T_1$ and $T_3$ transistor driving periods, a sufficiently fast driving can be achieved only in the direct driving period as the voltage difference to be driven is equal to or less than the threshold voltage.

In addition, this embodiment eliminates the precharge performed in the first embodiment and more power saving and faster driving can be accomplished over the first embodiment. The reason is that the NMOS transistor 15 is operated in the transistor driving period when the output voltage is higher than the output voltage in the previous output period, and the PMOS transistor 16 is operated when the output voltage is lower than the output voltage in the previous period. As described in the first embodiment, this embodiment also achieves a fast driving even with a large resistance value of the resistance string and the consumption power can be decreased for the entire driving circuit. In addition, when this embodiment is used for a data driver IC with multiple outputs, a highly precise voltage output can be provided even though variations occur in the threshold voltage of the transistor between the ICs or within the IC.

It should be noted although the drain of the NMOS transistor 15 or the drain of the PMOS transistor 16 is connected to the voltage source with a constant voltage in FIG. 10, the transistor may be connected to an arbitrary voltage source with variable voltages for each output period.

In this way, a high precise voltage output, fast driving and low consumption power can be simultaneously achieved with a simple circuit structure in this embodiment.

Figure 12:
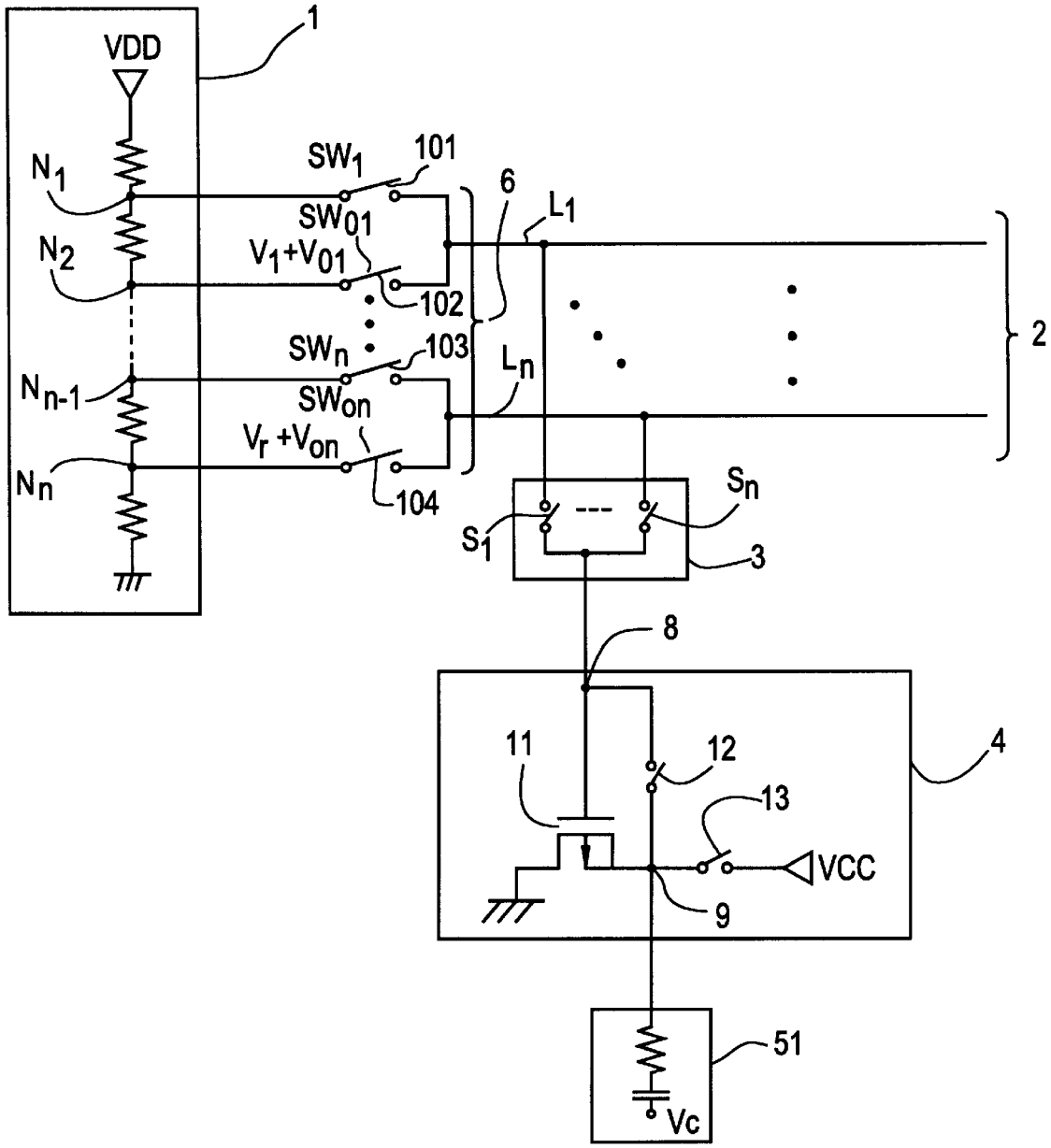
FIG. 12 is a circuit diagram of a driving circuit for a liquid crystal display of a fourth embodiment in accordance with the present invention.

Referring to FIG. 12, a driving circuit for a liquid crystal display of a fourth embodiment in accordance with the present invention is a circuit provided by partly improving the driving circuit shown in FIG. 5, and the structures of the selection circuit 3 and the output circuit 4 are the same as those of FIG. 5. Referring to FIG. 12, a description will hereinafter be made of the component which is different from that of FIG. 5. A multi-value voltage generating circuit 1 comprises a resistance string having resistance elements connected in series, n (where n is a natural number) gradation voltages and n auxiliary voltages shifted from each gradation voltage by a predetermined voltage are outputted from 2n connecting terminals within the resistance string. An arbitrary gradation voltage is denoted by Vk (where k is a natural number equal to or less than n), an auxiliary voltage shifted from the gradation voltage Vk by a voltage Vok (where k is a natural number equal to or less than n) is denoted by (Vk+Vok), and a gradation voltage line for outputting the gradation voltage Vk or the auxiliary voltage (Vk+Vok) is denoted by Lk (where k is a natural number equal to or less than n). It should be noted that Vok<0 in FIG. 12. Switches SWk and SWok are connected between each connecting terminal within the resistance string for generating the gradation voltage Vk and the auxiliary voltage (Vk+Vok) and the gradation voltage line Lk, and are controlled such that the gradation voltage Vk or the voltage (Vk+Vok) may be outputted to the gradation voltage line Lk. 2n switches connected similarly for all ks are referred to as a switch group 6. It should be noted that for facilitating the following description of the driving method, switches for controlling outputs of a gradation voltage V1, an auxiliary voltage (V1+Vo1), a gradation voltage Vn and an auxiliary voltage (Vn+Von) are referred to as switches 101, 102, 103 and 104, respectively in the switch group 6.

Figure 13:
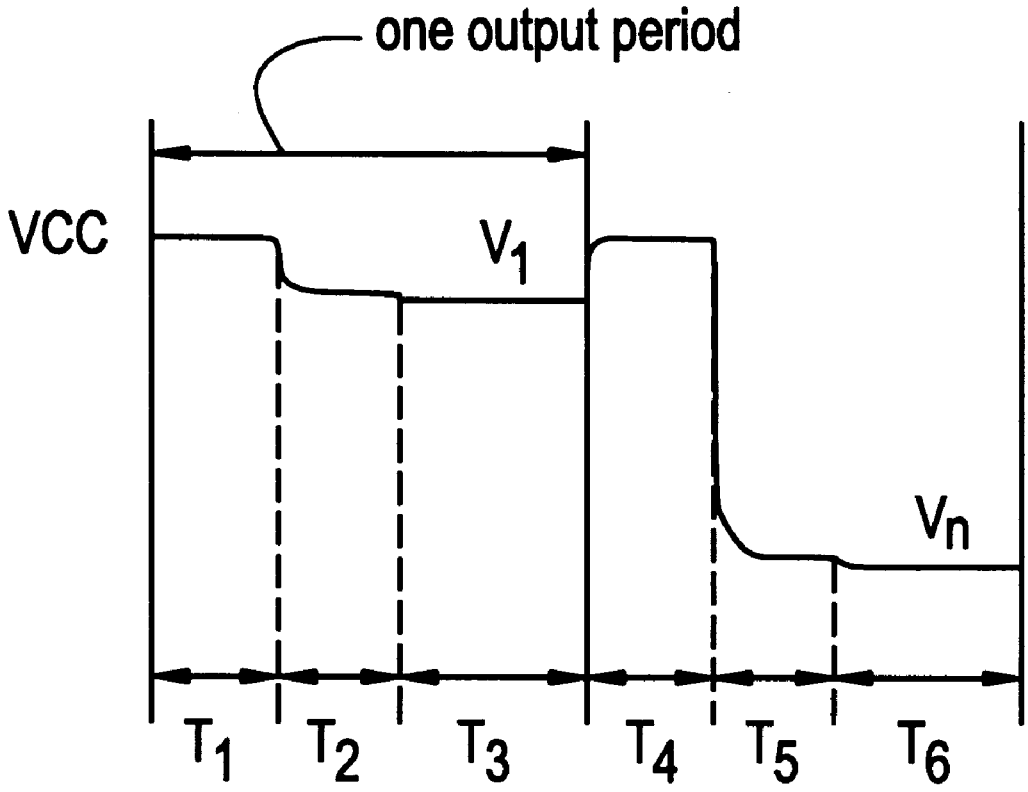
FIG. 13 is an output waveform diagram of a driving example in the driving circuit shown in FIG. 12.

FIG. 13 is an output waveform diagram of a data line load 5 for two output periods showing a driving example of the circuit structure shown in FIG. 12. Table 4 shows the state of the switches 101 to 104 of the switch group 6 in such a case.

TABLE 4

| | $T_1$ | $T_2$ | $T_3$ | $T_4$ | $T_5$ | $T_6$ |
|---|---|---|---|---|---|---|
| selection circuit 3 | all off | only $S_1$ on | | all off | only $S_n$ on | |
| switch 101 | off | | on | off | | on |
| switch 102 | on | | off | on | | off |
| switch 103 | off | | on | off | | on |
| switch 104 | on | | off | on | | off |
| switch 12 | on | off | | on | off | on |
| switch 13 | on | off | | on | off | |

The driving method will be described below based on the table. The controlling method of the switch 12 and the switch 13 in $T_1$ to $T_6$ is similar to that of the first embodiment, $T_1$ and $T_4$ are precharge periods, $T_2$ and $T_5$ are transistor driving periods and $T_3$ and $T_6$ are direct driving period in which an output of the selection circuit 3 is directly outputted to the one data line load 5. The switch group 6 is further provided in this embodiment, the control and effect of the switch group 6 will be described. The switch group 6 is controlled such that the auxiliary voltage (Vk+Vok) is outputted to the gradation voltage line group 2 in the precharge period and the transistor driving period, and the gradation voltage Vk is outputted to the gradation voltage line group 2 in the direct driving period. Specifically, the switches for controlling the output of the gradation voltage such as the switches 101, 103 are all turned off and the switches for controlling the output of the auxiliary voltage such as the switches 102, 104 are all turned on in $T_1$, $T_2$. When a switch $S_1$ in the selection circuit 3 is turned on in $T_2$, an auxiliary voltage (V1+Vo1) is biased to a gate of the PMOS transistor 11, the voltage of the one data line load 5 falls rapidly from the precharge voltage VCC to the voltage (V1+Vo1−VT). When the switches for controlling the output of the gradation voltage such as the switches 101, 103 are turned all on and the switches for controlling the output of the auxiliary voltage such as the switches 102, 104 are all turned off in $T_3$, the voltage of the gradation voltage line group 2 is switched from the auxiliary voltage to the gradation voltage, and the gradation voltage V1 selected in the selection circuit 3 is directly outputted to the one data line load 5. Similarly, for $T_4$ to $T_6$, a voltage (Vn+Von−VT) is outputted in $T_5$ , a gradation voltage Vn is outputted to the one data line load 5 in $T_6$. This action is similar when an arbitrary gradation voltage Vk is outputted. Although an effect similar to that of the first embodiment can be obtained through such driving method, this embodiment can realize a faster driving and lower consumption power compared with the first embodiment. The reasons will hereinafter be described. When a substrate bias voltage of the PMOS transistor 11 is equal to a source voltage, a threshold voltage VT of the PMOS transistor 11 is constant regardless of a gate bias voltage in this embodiment. In this case, for the design of the resistance string in the multi-value voltage generating circuit 1, the voltage Vok can be set at a constant value for all ks. When the Vok is designed to have a value near the VT, a fast driving can be achieved up to near a desired gradation voltage Vk as the voltage of the one data line load 5 is (Vk+Vok−VT) in the transistor driving period. Although the voltage difference for the threshold voltage VT of the PMOS transistor 11 must be driven in the direct driving period in the first embodiment, only a small voltage difference which is not depending on the threshold voltage VT needs to be driven in the direct driving period by setting the Vok in this embodiment. Thus, this embodiment can achieve a sufficiently fast driving even though the resistance string is designed to have a resistance value larger than the required value in the first embodiment, thereby making it possible to suppress a current across the resistance string to more decrease the consumption power of the driving circuit compared with the first embodiment.

In addition, this embodiment can be applied for the second embodiment including the output circuit 4 using the NMOS transistor, a similar effect to that of this embodiment can also be obtained in such a case.

Next, for the driving circuits for the liquid crystal display described in the first to fourth embodiments, the effects of the present invention will be demonstrated from the results for the driving speed and consumption power obtained by specifically performing a simulation. It should be noted that the second embodiment (FIG. 8) includes the NMOS transistor 14 in place of the PMOS transistor 11 in the output circuit 4 of the first embodiment (FIG. 5) and the resulting effects are similar to those of the first embodiment, so that the demonstration of effects through the simulation for the second embodiment (FIG. 8) will be omitted in the simulation.

Figure 14:
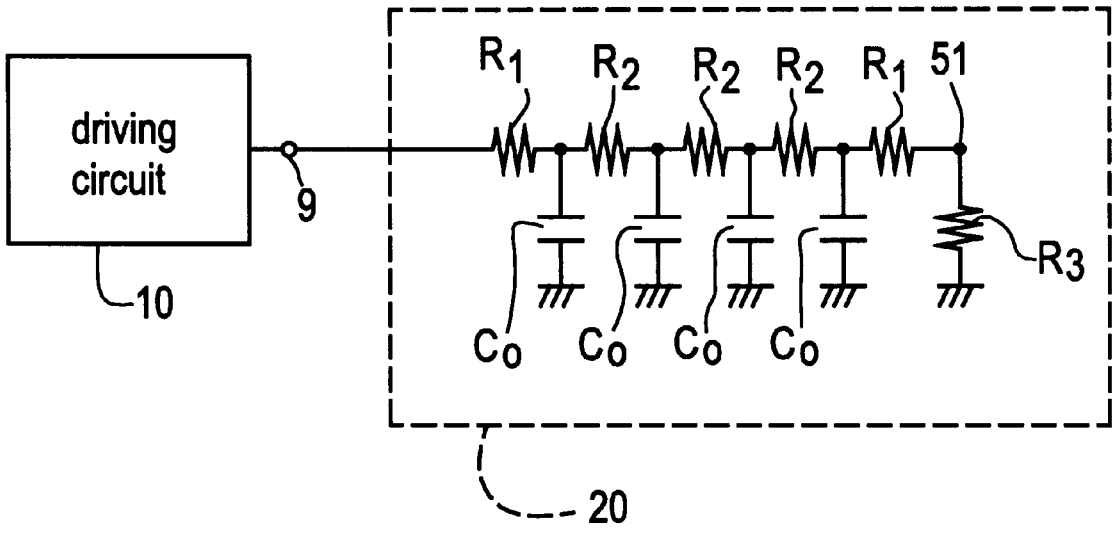
FIG. 14 is an equivalent circuit diagram of a data line load used for a simulation of a driving circuit.

The simulation is performed such that a one data line load corresponding to a VGA panel with 9 inches in diagonal is connected to the driving circuits (shown in FIG. 5, FIG. 10 and FIG. 12) in accordance with the present invention and the driving speed and the consumption power are estimated from the change in an output voltage at the end of the data line for each driving circuit. FIG. 14 shows an equivalent circuit of the one data line load used for the simulation. A driving circuit 10 is the one data line driving circuit having the circuit structure shown in FIG. 5, FIG. 10 and FIG. 12, and a one data line load 20 is an equivalent circuit including a liquid crystal capacity, wiring resistances $R_1$, wiring capacities Co, and terminal resistance $R_3$. Assuming that $R_1$=5 kΩ, $R_2$=10 kΩ, $R_3$=1 GΩ and Co=10 pF. In the simulation, an arbitrary voltage source VCC of the driving circuit 10 is equal to a supply voltage VDD and VDD=5 V. Also, one output period of the driving circuit 10 to the data line load is 40 μs. It should be noted that for estimating the driving speed, the driving speed is dependent on a gradation in the direct driving period, so that the output setting voltage is set to have three levels of 0.5 V, 2.5 V and 4.5 V, and the output for one cycle is performed from the initial state at 4.5 V, then at 2.5 V in a first output period, at 0.5 V in a second output period, at 2.5 V in a third output period and at 4.5 V in a fourth period. For estimating the driving speed, time from the starting of each output period to the reaching of 40 mV precision for the output setting voltage is estimated using a graduation voltage precision (40 mV) of the VGA panel. It should be noted that a precharge period is included in the time. In addition, for estimating the consumption power, the power consumed at the supply voltage VDD when the one data line load 20 is driven in one cycle period is estimated. This consumption power is one through a current across the resistance string and a charge and discharge of the one data line load and is a driving consumption power per data line. In the case of a driving circuit for outputting to multiple data lines, the current across the resistance string is proportional to the number of data lines and the driving consumption power is also proportional to the number of data lines.

Figure 1:
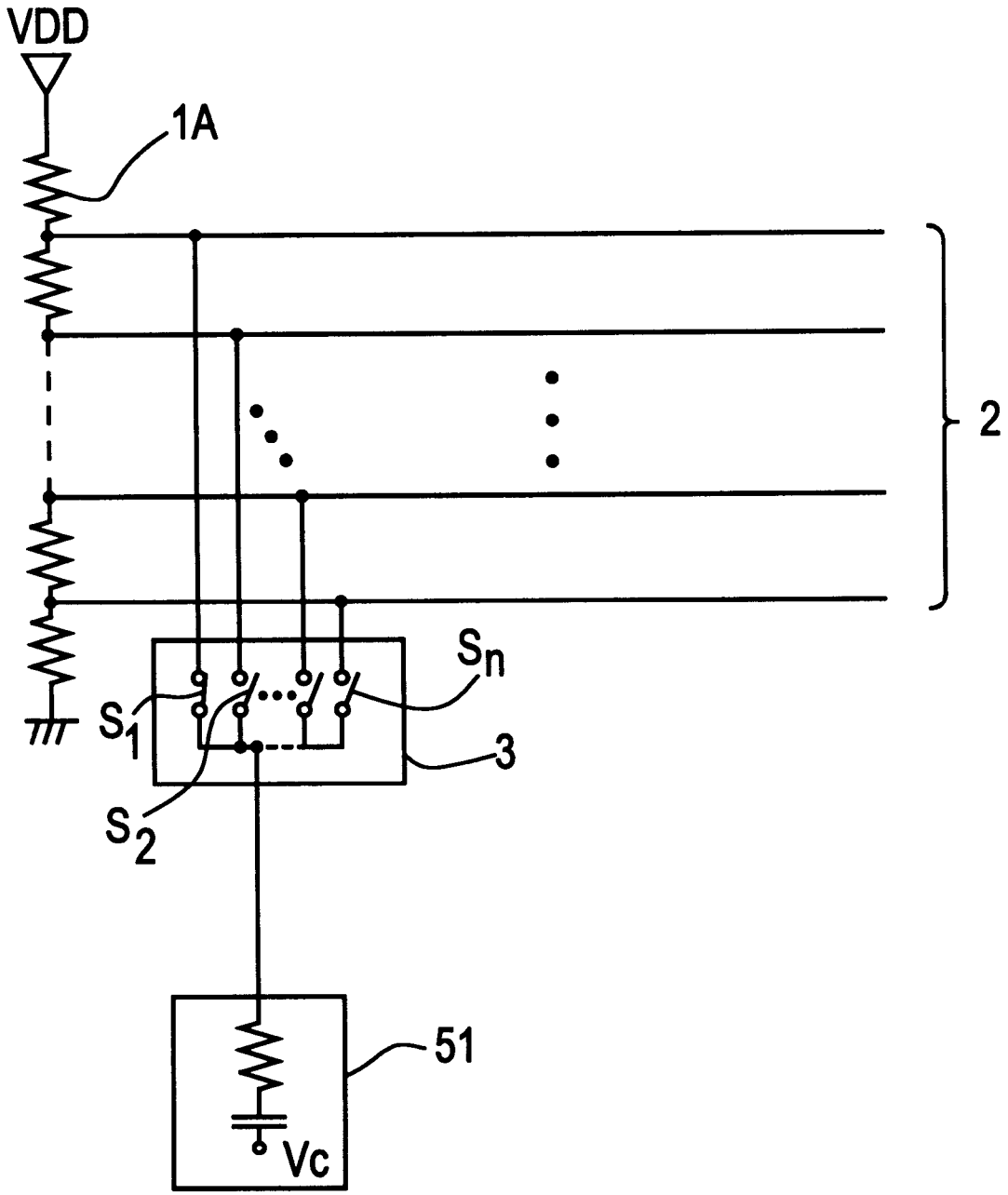
FIG. 1 PRIOR ART
FIG. 1 is a circuit diagram of a first prior art.
Figure 2:
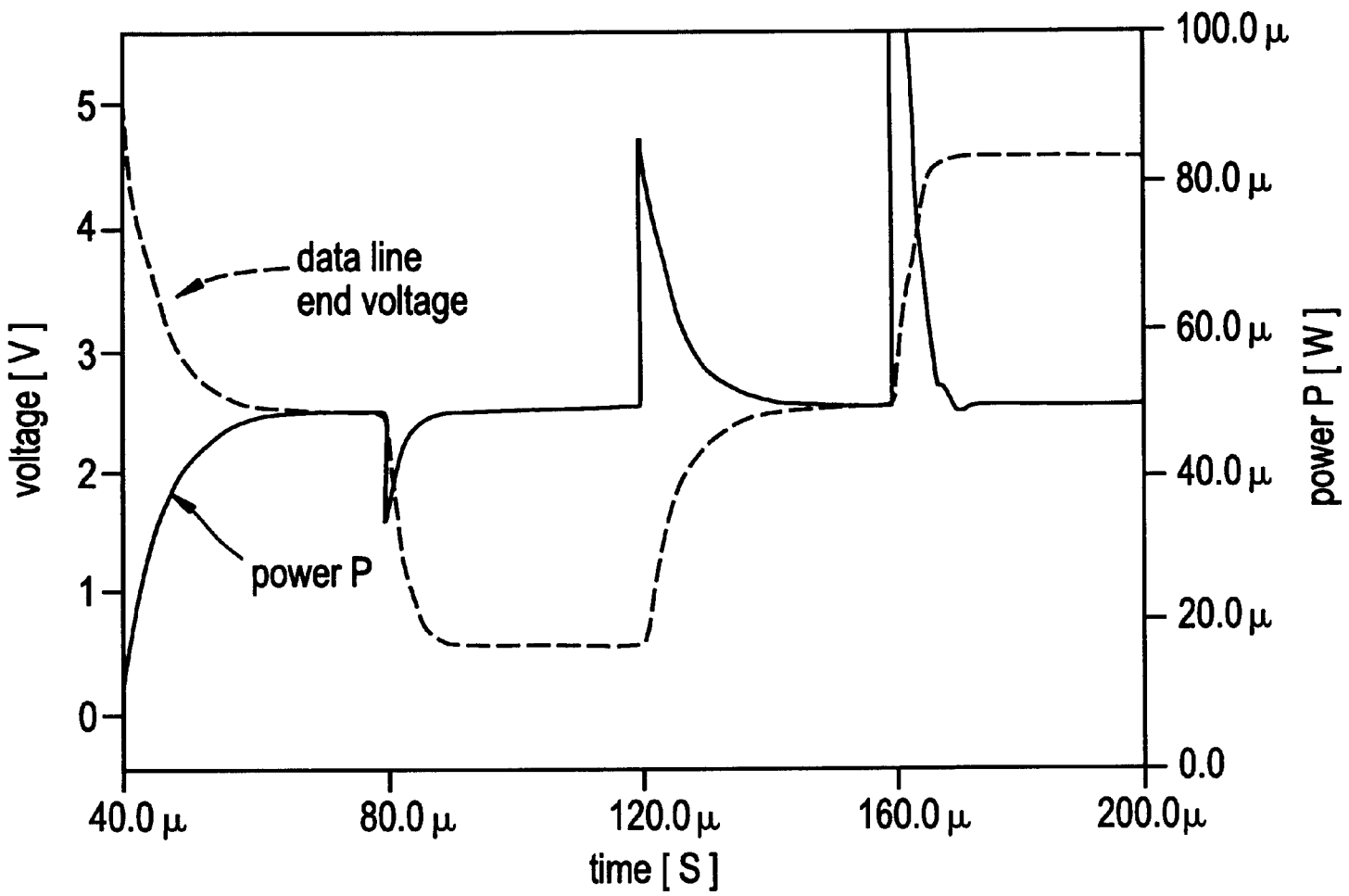
FIG. 2 PRIOR ART
FIG. 2 is an output waveform diagram of the first prior art.
Figure 3:
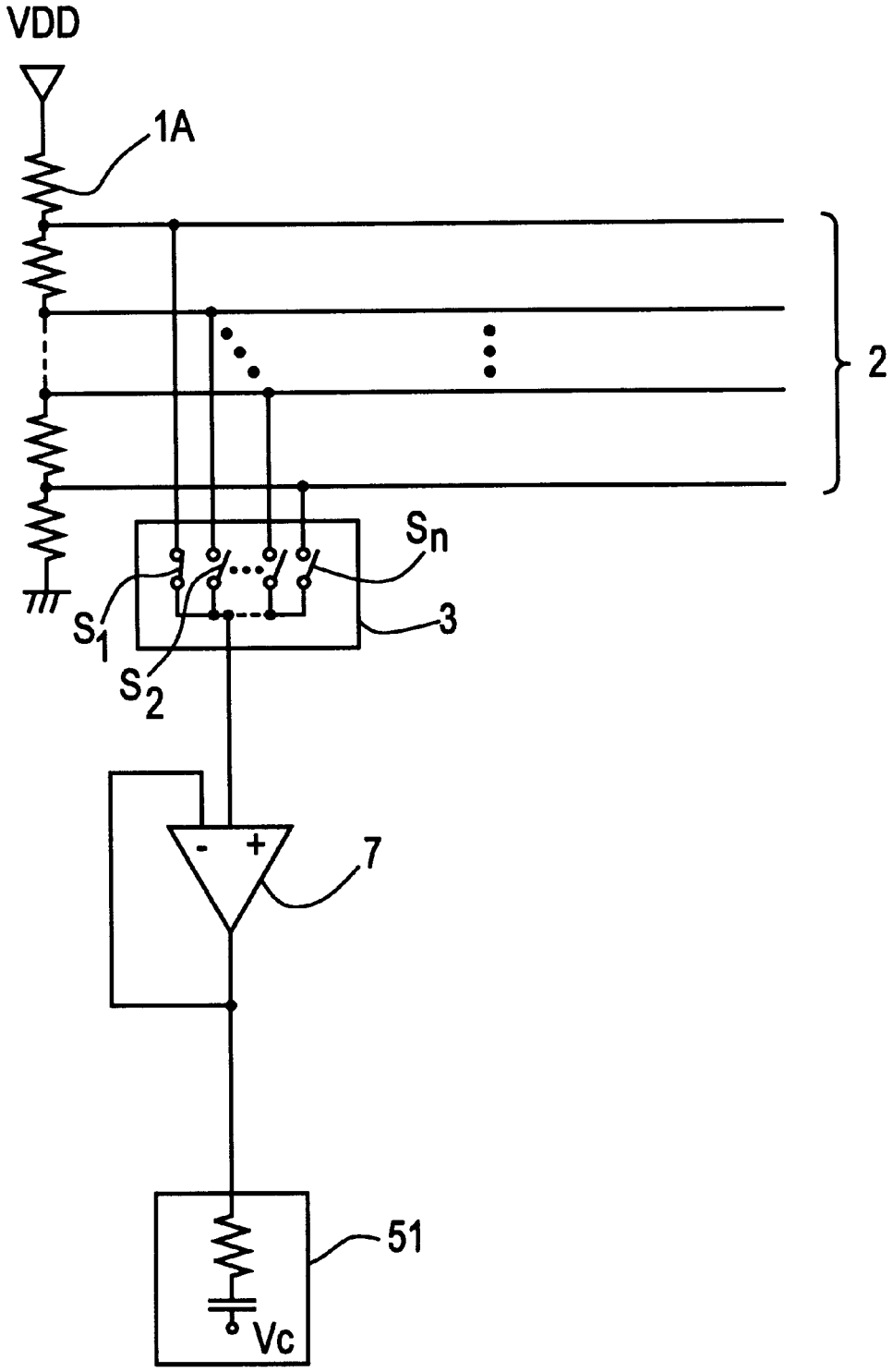
FIG. 3 PRIOR ART
FIG. 3 is a circuit diagram of a second prior art.
Figure 4:
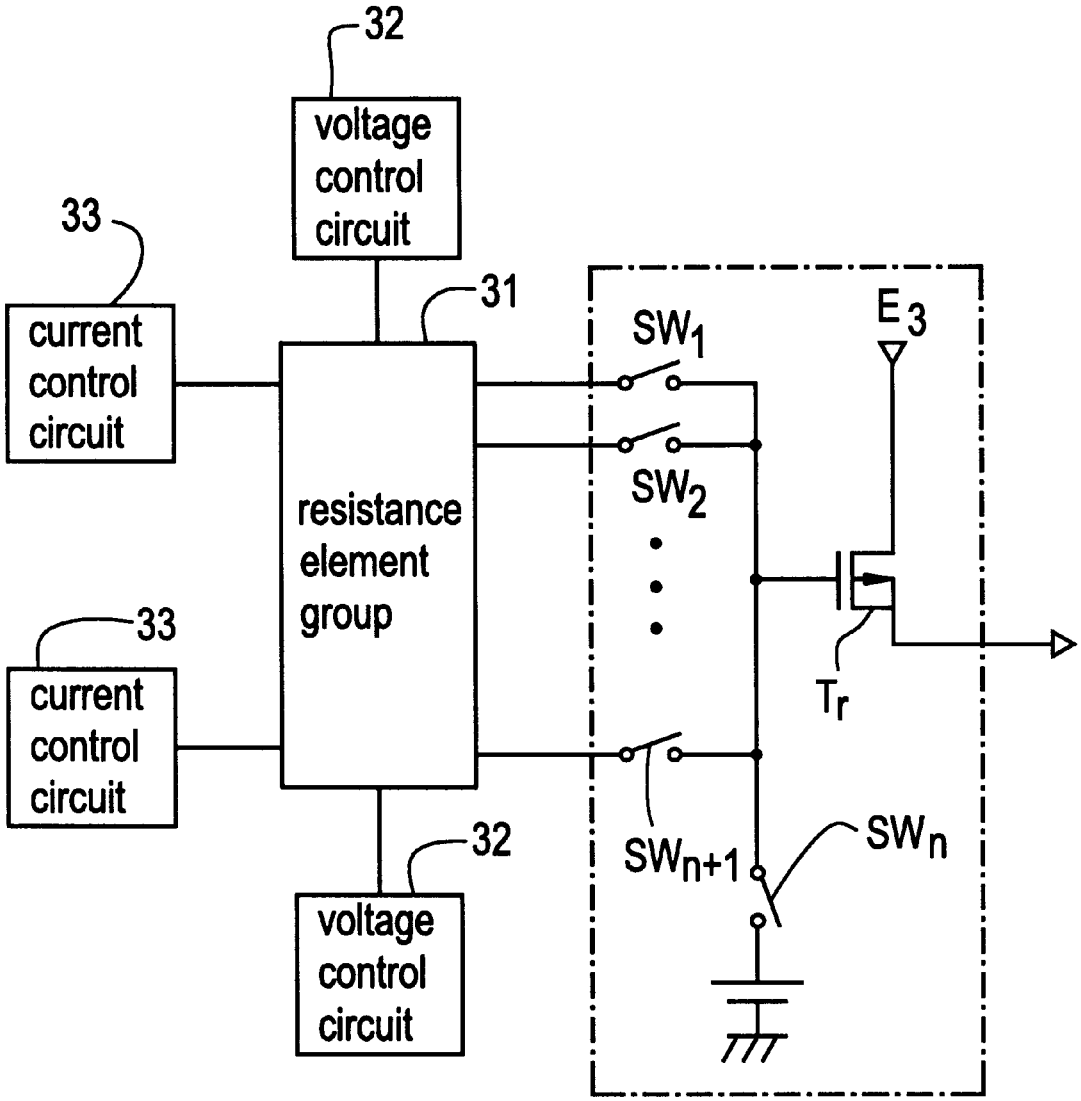
FIG. 4 PRIOR ART
FIG. 4 is a circuit diagram of a third prior art.

In addition, for a comparison with the present invention, a similar simulation is performed for the first prior art (FIG. 1). A comparison is made with the present invention when a current of 10 μA is conducted across the resistance string in the first prior art. FIG. 2 is an output waveform diagram obtained by the simulation performed for the first prior art.

EXAMPLE 1

Figure 15:
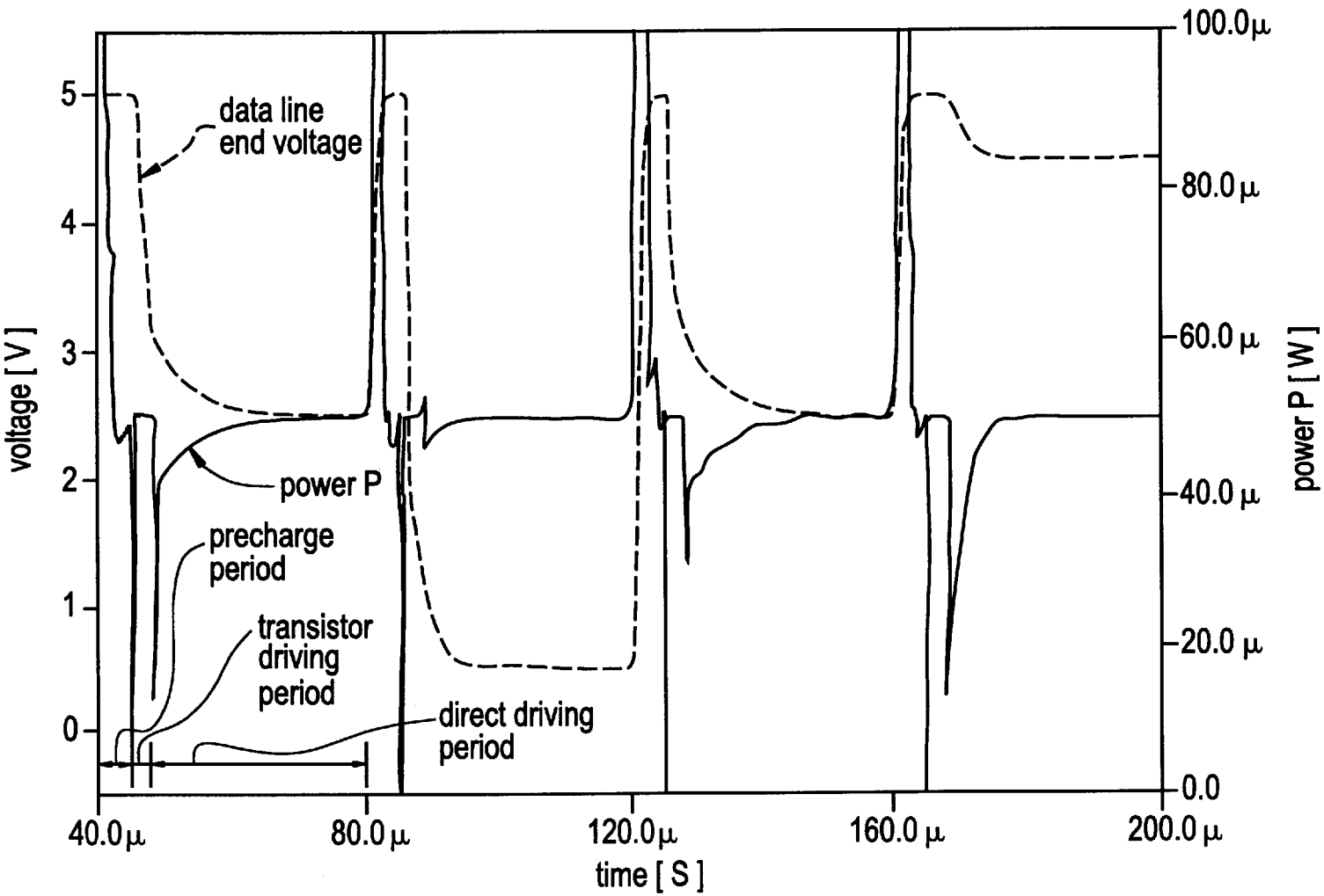
FIG. 15 is an output waveform diagram of a first example.

FIG. 15 is an output waveform diagram of a data line end voltage (dotted line) for one cycle (four output periods) and a power P (solid line) consumed at the supply voltage VDD in the first embodiment (FIG. 5). The driving condition is that the current across the resistance string is I=10 μA and the threshold voltage of the PMOS transistor 11 is VT=−0.5 V. The driving timing for one output period is shown in Table 5.

TABLE 5

Figure 16:
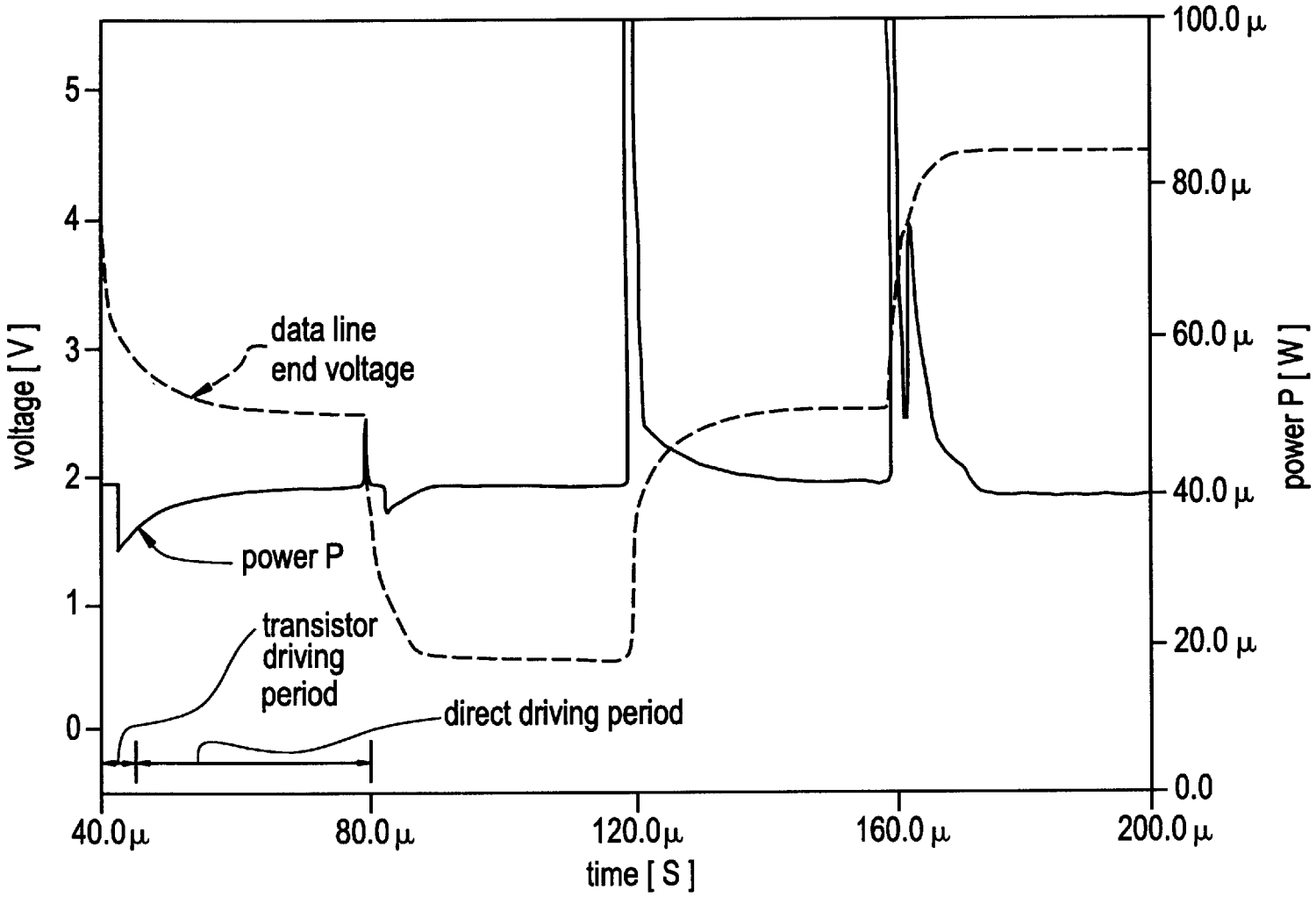
FIG. 16 is an output waveform diagram of a second example.
Figure 17:
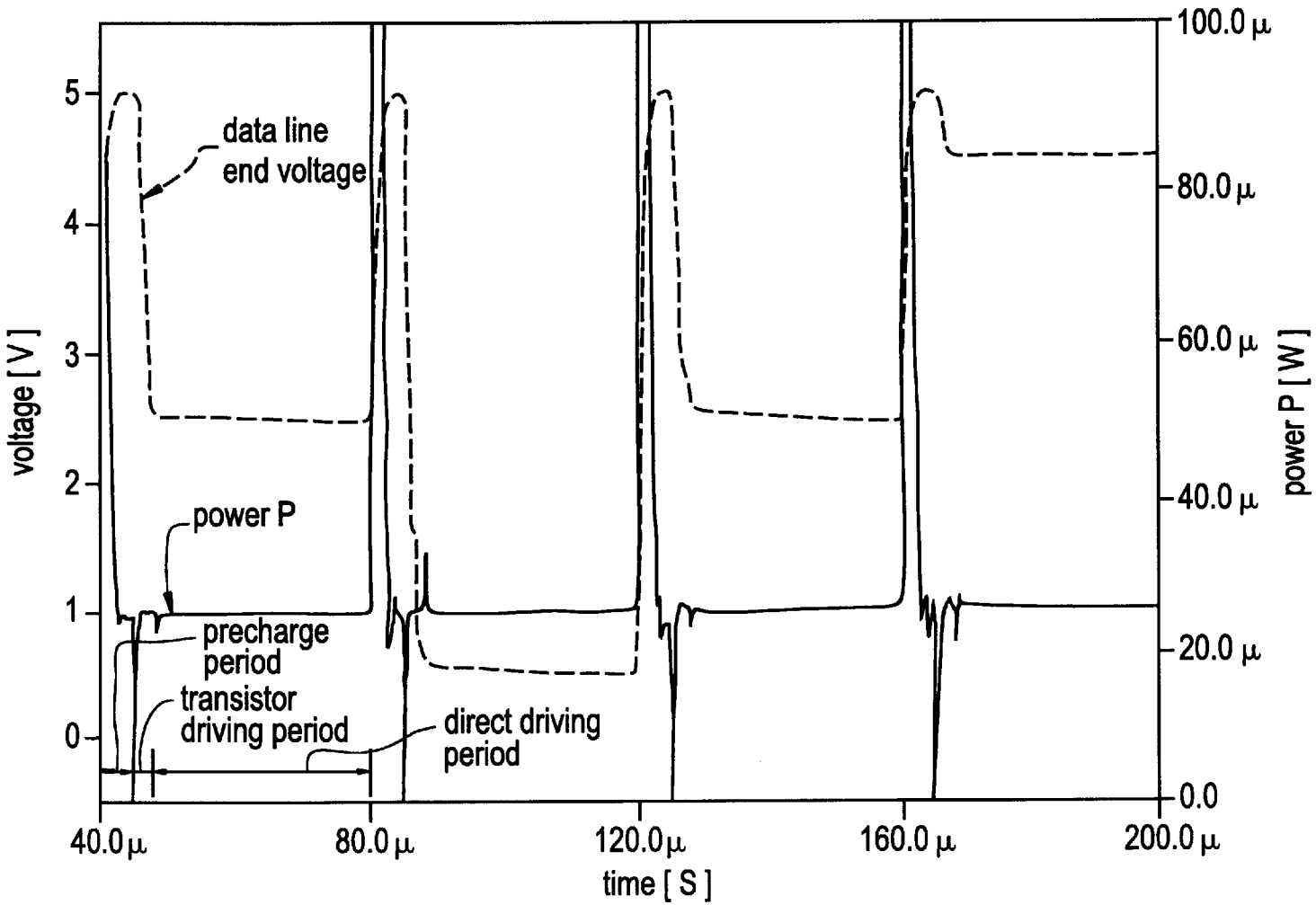
FIG. 17 is an output waveform diagram of a third example.

| | circuit diagram | output waveform diagram | precharge period | transistor driving period | direct driving period |
|---|---|---|---|---|---|
| example 1 | FIG. 5 | FIG. 15 | 5 μs | 3 μs | 32 μs |
| example 2 | FIG. 10 | FIG. 16 | | 3 μs | 37 μs |
| example 3 | FIG. 12 | FIG. 17 | 5 μs | 3 μs | 32 μs |
| first prior art | FIG. 1 | FIG. 2 | | | 40 μs |

A precharge period is 5 μs, a transistor driving period is 3 μs and a direct driving period is 32 μs. It is apparent that the change in data line end voltage is rapid in the transistor driving period as compared with the first prior art (FIG. 2).

Table 6 shows a comparison with the first prior art of 40 mV precision reaching time and the consumption power.

TABLE 6

| | circuit diagram | driving condition | 40 mV precision reaching time [μs] 5 V→2.5 V | →0.5 V | →2.5 V | →4.5 V | consumption power [μW] |
|---|---|---|---|---|---|---|---|
| example 1 | FIG. 5 | I = 10 μA, VT = −0.5 V | 22.6 | 14.0 | 22.6 | 13.9 | 57.2 |
| | | I = 8 μA, VT = −0.2 V | 21.2 | 13.8 | 21.2 | 13.0 | 47.4 |
| example 2 | FIG. 10 | I = 8 μA, VT = 0.5 V, VT = −0.5 V | 20.8 | 9.7 | 21.0 | 11.8 | 48.1 |
| example 3 | FIG. 12 | I = 5 μA, VT = −0.5 V, Vok = −0.55 V | 8.5 | 12.7 | 8.4 | 7.1 | 33.6 |
| first prior art | FIG. 1 | I = 10 μA | 21.2 | 8.8 | 21.2 | 8.7 | 51.8 |

When a gradation voltage generated in the resistance string is directly outputted to the data line load 20, the driving speed varies depending on the gradation voltage as the time constant varies depending on the gradation voltage. As seen from Table 6, 40 mV precision reaching time is the longest when the output voltage is 2.5 V, which determines the driving speed of the driving circuit.

The driving circuit shown in FIG. 5 is rather below the first prior art in both the driving speed and consumption power when the driving condition is I=10 μA and VT=−0.5 V. This is because the driving circuit shown in FIG. 5 requires precharge, so that there is a precharge period and a time required by extra charge and discharge due to the precharge. However, when the threshold voltage of the PMOS transistor 11 is changed from VT=−0.5 V to VT=−0.2 866 V and the current across the resistance string is changed to I=8 μA, the driving circuit shown in FIG. 5 can be above the first prior art in both the driving speed and consumption power. Therefore, when a transistor with a small absolute value of the threshold voltage is used, the voltage difference which must be driven in the direct driving period is smaller and the driving speed is faster, so that the current across the resistance string can be suppressed and the consumption power can be decreased within the limit of a required driving speed. In this way, the effects of the driving circuit in accordance with the present invention (FIG. 5) is shown.

FIG. 16 is an output waveform diagram of a data line end voltage (dotted line) for one cycle (four output periods) and a power P (solid line) consumed at the supply voltage VDD in the third embodiment (FIG. 10). The driving condition is that the current across the resistance string is I=8 μA, the threshold voltage of the NMOS transistor 15 is Vt=0.5 V, the threshold voltage of the PMOS transistor 16 is VT=−0.5V, and both MOS transistors 15, 16 have the substrate voltage equal to the source voltage. The driving timing for one output period is shown in Table 5. Precharge is not required for the driving circuit shown in FIG. 10, the transistor driving period is 3 μs and the direct driving period is 37 μs. It is apparent that the change in the data line end voltage is rapid in the transistor driving period compared with the first prior art (FIG. 2). Table 6 shows a comparison with the first prior art of the 1LSB precision reaching time and consumption power.

Precharge is not required for the driving circuit shown in FIG. 10, 40 mV precision reaching time is shorter than that of the driving circuit shown in FIG. 5, and the power consumption by the precharge does not exist. Thus, even though the current across the resistance string is 8 μA, the driving circuit shown in FIG. 10 is above the driving circuit of the first embodiment shown in FIG. 5 in both the driving speed and consumption power. If a transistor with a small absolute value of the threshold voltage is used similar to the first embodiment, a faster driving and a lower consumption power can be achieved.

FIG. 17 is an output waveform diagram of a data line end voltage (dotted line) for one cycle (four output periods) and a power P (solid line) consumed at the supply voltage VDD in the fourth embodiment (FIG. 12). The driving condition is that the current across the resistance is I=5 μA, the threshold voltage of the P type transistor 11 is VT=−0.5 V, and Vok=−0.55 V (where k is a natural number equal to or less than n). The driving timing for one output period is shown in Table 4. The driving timing is similar to that of the first embodiment, and the precharge period is 5 μs, the transistor driving period is 3 μs and the direct driving period is 32 μs. It is apparent that the change in the data line end voltage is rapid in the transistor driving period compared with the first prior art (FIG. 2). Table 6 shows a comparison with the first prior art of 40 mV precision reaching time and consumption power.

The voltage difference which must be driven in the direct driving period can be sufficiently small regardless of the threshold voltage of the transistor by optimally setting the voltage Vok in the driving circuit shown in FIG. 12, so that 40 mV precision reaching time can be sufficiently small and the current across the resistance string can be suppressed. It should be noted that the gate bias is set to be 0 V when the auxiliary voltage biased to the gate of the PMOS transistor 11 in the transistor driving period is (Vk=Vok)<0. Thus, although the gate bias is ideally −0.05 V when the output voltage is 0.5 V in this embodiment, it is actually 0 V, so that 40 mV precision reaching time is somehow long, i.e. 12.7 μs. In this case, however, a faster driving and a lower consumption power can be realized compared with the first embodiment and the driving circuits shown in FIG. 5 and FIG. 10.

While preferred embodiments of the present invention have been described using specific terms, such description is for illustrative purposes only, and it is to be understood that changes and variations may be made without departing from the spirit or scope of the following claims.

What is claimed is:

1. A driving circuit for a liquid crystal display comprising:

multi-value voltage generating means for generating a plurality of voltages;

selection circuit means for selecting a voltage required for driving from the voltages generated by said multi-value voltage generating means; and output circuit means for inputting the voltage selected by said selection circuit means, and outputting a desired voltage to a driving circuit output terminal, wherein said output circuit means includes an output circuit input terminal for inputting the voltage selected by said selection circuit means, said driving circuit output terminal, a first voltage source, a second voltage source, a first switch connected between said output circuit input terminal and said driving circuit output terminal, a transistor having a drain connected to said first voltage source, a gate connected to said output circuit input terminal and a source connected to said driving circuit output terminal, and a second switch connected between said driving circuit output terminal and said second voltage source.

2. A driving circuit for a liquid crystal display according to claim 1, wherein said output circuit means has three stages of driving periods, that is, a first driving period in which said driving circuit output terminal is precharged to a predetermined voltage with said second voltage source by controlling said first switch and said second switch, a second driving period in which said transistor is operated as a source follower to output a voltage to said driving circuit output terminal and a third driving period in which the voltage at said output circuit input terminal is directly outputted to said driving circuit output terminal through said first switch.

3. A driving circuit for a liquid crystal display according to claim 1, wherein said multi-value voltage generating means is a voltage dividing circuit comprising a third voltage source, a fourth voltage source and a resistance element group connected between the third voltage source and the fourth voltage source.

4. A driving circuit for a liquid crystal display according to claim 1, wherein said multi-value voltage generating means includes means for generating n voltages Vk (k=1,2,. . . ,n) and n auxiliary voltages Vk+Vok (k=1,2,. . . ,n) which are shifted by the voltage Vok from the voltages Vk, multi-value voltage generating means output terminal from which said n voltages Vk or said n auxiliary voltages Vk+Vok are outputted, a first switch group for controlling an output of said n voltages Vk to said multi-value voltage generating means output terminal, and a second switch group for controlling an output of said n auxiliary voltage Vk+Vok to said multi-value voltage generating means output terminal.

5. A driving circuit for a liquid crystal display comprising:

multi-value voltage generating means for generating a plurality of voltages;

selection circuit means for selecting a voltage required for driving from the voltages generated by said multi-value voltage generating means; and output circuit means for inputting the voltage selected by said selection circuit means, and outputting a desired voltage to a driving circuit output terminal, wherein said output circuit means includes an output circuit input terminal for inputting the voltage selected by said selection circuit means, said driving circuit output terminal, a first voltage source, a second voltage source, a switch connected between said output circuit input terminal and said driving circuit output terminal, an n channel type MOS transistor having a drain connected to the first voltage source, a gate connected to said output circuit input terminal and a source connected to said driving circuit output terminal, and a p channel type MOS transistor having a drain connected to said second voltage source, a gate connected to said output circuit input terminal and a source connected to said driving circuit output terminal.

6. A driving circuit for a liquid crystal display according to claim 5, wherein said output circuit means has two stages of driving periods, that is, a first driving period in which said n channel type MOS transistor or said p channel type MOS transistor is operated as a source follower to output a voltage to said driving circuit output terminal by controlling said switch, a second driving period in which the voltage at said output circuit input terminal is directly outputted to said driving circuit output terminal through said switch.

7. A driving circuit for a liquid crystal display according to claim 5, wherein said multi-value voltage generating means is a voltage dividing circuit comprising a third voltage source, a fourth voltage source and a resistance element group connected between the third voltage source and the fourth voltage source.

8. A driving circuit for a liquid crystal display according to claim 5, wherein said multi-value voltage generating means includes means for generating n voltages Vk (k=1,2,. . . ,n) and n auxiliary voltages Vk+Vok (k=1,2,. . . ,n) which is shifted by the voltage Vok from the voltage Vk, multi-value voltage generating means output terminal from which said n voltages Vk or said n auxiliary voltages Vk+Vok are outputted, a first switch group for controlling an output of said n voltages Vk to said multi-value voltage generating means output terminal, and a second switch group for controlling an output of said n auxiliary voltages Vk+Vok to said multi-value voltage generating means output terminal.

* * * * *